United States Patent [19]

Dornbusch et al.

[11] Patent Number: 4,475,837

[45] Date of Patent: Oct. 9, 1984

[54] ROLL-ON APPLICATING PACKAGE WITH SEALING CAP

[75] Inventors: Arthur H. Dornbusch; Suzanne Benigni, both of Cincinnati, Ohio; Clarence R. Peace, Jr., Edgewood, Ky.

[73] Assignee: The Procter & Gamble Company, Cincinnati, Ohio

[21] Appl. No.: 368,350

[22] Filed: Apr. 14, 1982

[51] Int. Cl.[3] ..... A45D 34/04; A45D 40/26

[52] U.S. Cl. ..... 401/213; 401/202; 401/247

[58] Field of Search ..... 401/202, 213, 243, 245, 401/247, 269, 196

[56] References Cited

U.S. PATENT DOCUMENTS

| | | | |
|---|---|---|---|
| 962,053 | 6/1910 | Von Rottenburg | 401/247 |
| 2,737,416 | 3/1956 | Behr et al. | 401/213 X |
| 2,823,403 | 2/1958 | Whitney . | |
| 2,998,616 | 9/1961 | Gentile . | |
| 3,090,987 | 5/1963 | Ruekberg . | |
| 4,030,844 | 6/1977 | Lench et al. | 401/213 |
| 4,050,826 | 9/1977 | Berghahn et al. | 401/196 |
| 4,164,377 | 8/1979 | Lohrman . | |
| 4,168,128 | 9/1979 | Fillmore et al. . | |
| 4,221,495 | 9/1980 | Braun et al. . | |

FOREIGN PATENT DOCUMENTS

| | | | |
|---|---|---|---|
| 817415 | 8/1951 | Fed. Rep. of Germany | 401/213 |
| 1020769 | 2/1953 | France | 401/213 |
| 628350 | 8/1949 | United Kingdom | 401/202 |

*Primary Examiner*—Steven A. Bratlie

*Attorney, Agent, or Firm*—Richard C. Witte; John V. Gorman; Ronald J. Snyder

[57] ABSTRACT

A roll-on applicating package is described which is adapted to dispense products incorporating a liquid which has a very low surface tension. The liquid tends to penetrate mechanical seals and migrate to outer surfaces of ordinary applicating packages, creating an unsightly appearance and a negative tactile impression. The package of the present invention includes a means to establish a primary seal and includes, within its closure, an absorptive insert adapted to make continuous contact with a lip surrounding the applicating roller when the package is sealed. The insert is made of a non-hygroscopic material which possesses an ability to draw the liquid into its exterior by capillary action. Because of the preferential migration of the liquid into the insert, outer surface fouling of the package is obviated.

4 Claims, 2 Drawing Figures

ROLL-ON APPLICATING PACKAGE WITH SEALING CAP

TECHNICAL FIELD

This invention relates to roll-on applicating packages such as are used for dispensing antiperspirants and deodorants and, more particularly, to an arrangement to prevent the migration of fugitive liquid components of the product to outer surfaces of the package, with attendant unsightliness and negative tactile impression.

BACKGROUND ART

Much work has been directed to sealing of roll-on applicating packages. U.S. Pat. No. 2,823,403, which issued to R. H. Whitney on Feb. 18, 1958, for example, discloses an arrangement wherein a mechanical seal is provided between the lower portion of the dispensing ball and a fitment when the package closure is applied. A similar arrangement, but one in which a second seal is provided between the upper lip of the fitment and the dispensing ball, is disclosed in U.S. Pat. No. 4,164,377, which issued to R. D. Lohrman et al. on Aug. 14, 1979. In the latter patent, the screw closure sidewall has an inwardly extending integrally molded annular bead which is adapted to force the lip of the fitment radially inwardly, wedging it against the ball, to establish the upper mechanical seal.

Other techniques have also been taught as shown, for example, in U.S. Pat. No. 2,998,616, which issued to C. J. Gentile on Sept. 5, 1961, wherein a sealing member constructed of a resiliently deformable material (such as rubber or a resilient synthetic resin) is secured to the cap topwall and has a skirt adapted to form a mechanical seal with the ball and with a bearing surface on the fitment.

A roll-on applicator with a sharp sealing ring is described in U.S. Pat. No. 4,221,495, which issued to M. Braun et al. on Sept. 9, 1980. In this patent, a dispenser similar to that of the described Whitney patent is equipped with a fitment provided with a sealing ridge which is formed by a pair of angled, planar annular faces to establish sharp-line, fluidtight contact with the dispensing ball.

U.S. Pat. No. 3,090,987, which issued to H. S. Ruekberg on May 28, 1963, is directed to a package in which the ball socket is integrally molded with the container to obviate the need of assembling a fitment on a container neck and of assuring a seal therebetween. Ruekberg also describes alternative embodiments in which single and double mechanical seals of the type described above are provided.

A further dual-seal, roll-on dispensing package is taught in U.S. Pat. No. 4,168,128, which issued to W. E. Fillmore et al. on Sept. 18, 1979. In this roller-type package the application of the closure forces the roller into contact with the bottom diaphram of the socket, thus establishing a lower seal. In addition, the closure has a quantity of resilient sealing material therein which is positioned to engage the upper surface of the roller and the lip of the fitment to provide a second seal when the closure is applied. The resilient sealing material can comprise foamed polymers, such as polyethylene foam or polyurethane foam, which are light in weight and effective as a sealing material. As a consequence, each of the seals is essentially of the mechanical type.

Despite all of the good work done, there remains a problem in sealing roll-on applicating dispensing packages when the product to be dispensed contains liquid components having very low surface tensions. For example, with antiperspirant compositions containing volative and/or nonvolatile silicone constituents it is extremely difficult, if not impossible, to economically provide a mechanical seal or seals which will uniformly and without fail prevent migration of such constituents. These silicones have surface tensions in the range of from about 18 to about 21 dynes/cm$^2$ at 25° C. and it has been found that at least trace amounts thereof will penetrate the seals of an unacceptable percentage of existing types of roll-on packages. The silicones spread to the outer surfaces of the containers and caps causing them to be unsightly and unpleasant to handle, a severe commercial detriment to a manufacturer.

It is an object of this invention to obviate the abovedescribed problems.

It is another object of the present invention to provide a roll-on dispensing package which economically provides protection against migration of fugitive liquids to external package surfaces to improve the visual and tactile impressions of the package.

DISCLOSURE OF THE INVENTION

In accordance with one aspect of the present invention, there is provided a roll-on applicating package adapted to contain and dispense products incorporating a liquid having a very low surface tension. The package includes a container comprising a body portion adapted to receive the product and having an integrally formed upper portion including an applicator socket terminating in a lip. A spheroidal applicator element is rotatably disposed within the socket with the lip thereof circumscribing and thereby enclosing a major portion of the applicator element within the socket. A closure is telescoped over, and encloses, the socket and applicator element. The closure has a topwall and a depending skirt-like sidewall. A porous, absorptive insert is mounted in the closure and has a surface in contact with the socket lip along substantially its entire perimeter. Means are provided to affix the closure to the container when the closure is in telescoped condition. Means are also provided to establish a continuous primary mechanical seal between the applicator element and the socket to resist leakage of product therethrough when the closure is in telescoped condition. The absorptive insert comprises a non-hygroscopic material which is chemically unreactive with the product and possesses capillary attraction with said liquid of a magnitude sufficient to cause preferential migration of the liquid into the material rather than spreading on the surface of the container when the liquid is in contact with both.

DETAILED DESCRIPTION OF THE INVENTION

Figure 1:
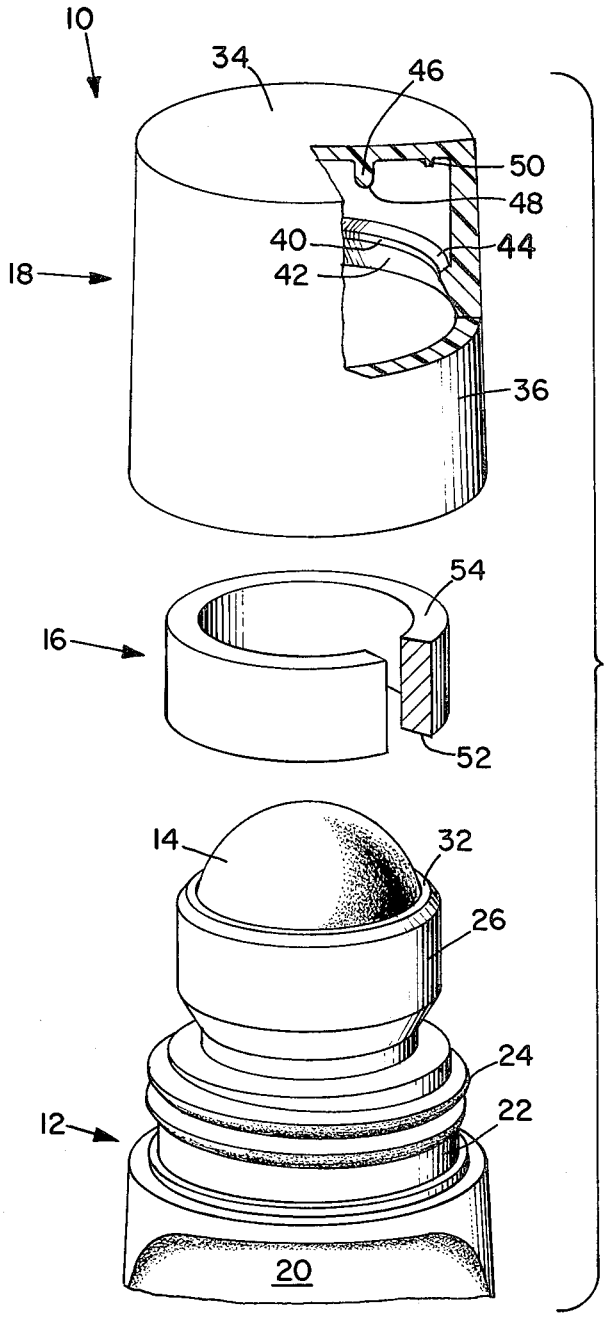
FIG. 1 is a fragmentary, exploded, perspective view of a preferred embodiment of the present invention, partially broken away and sectioned for clarity.

Referring now to the drawings in detail, wherein like numerals indicate the same elements throughout the views, there is illustrated a preferred embodiment of a roll-on applicating package of the present invention. The package 10 includes a container 12 for the product to be dispensed, an applicator element, ball 14, rotatably disposed within the upper extremity of the container 12, a porous, absorptive insert 16 and a closure 18.

Figure 2:
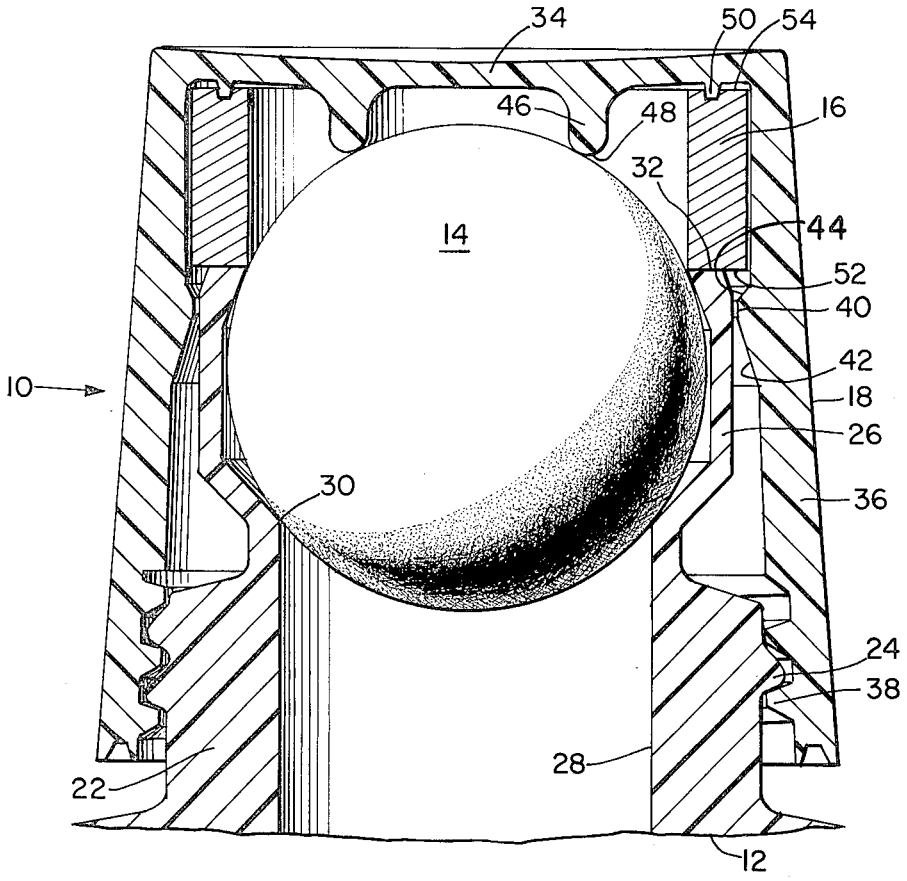
FIG. 2 is a fragmentary, enlarged, vertical sectional view of the embodiment of FIG. 1.

The container 12 is constructed of a flexible, moldable polymeric material such as polyolefins (such as polyethylene or polypropylene) and has a body portion 20, a cylindrical neck 22 provided on its exterior with screw threads 24 and an integrally formed applicator socket 26. The balance of the body portion 20 which is not shown may be of any desired configuration and provides a closed end chamber suitable for containing the product to be dispensed. A passageway 28 through neck 22 leads from the interior of the body portion 20 to the socket 26 and provides a channel for egress of product during the dispensing operation. At the intersection of passageway 28 and the socket 26, as shown in FIG. 2 a sharp annular, transverse, inwardly directed sealing shoulder or ridge 30 is formed to serve as the locus of a primary seal for the package 10. The upper extremity of the socket 26 terminates in an annular lip 32, the upper surface of which is horizontal and planar.

Ball 14 is spherical, preferably made of molded polystyrene or polypropylene, and has a smooth finish. The ball 14 and applicator socket 26 are so sized with relation to one another to permit the ball 14 to snapped into the socket 26 interior, with the major portion of the ball 14 enclosed therein and a minor portion protruding beyond the circumscribing lip 32. In assembled condition the ball 14 is freely rotatably disposed within the socket 26 when the closure 18 is unapplied.

The closure 18 is generally cup-shaped with a topwall 34 and a depending skirt-like sidewall 36. Preferably, the closure 18 is injection molded of a fairly rigid polymer such as polypropylene or the like. The lower internal surface of sidewall 36 has threads 38 formed thereon and adapted to engage with threads 24 on the neck 22 of container 12 when the closure 18 is applied. An inwardly extending annular support bead 40 is formed on the upper internal surface of sidewall 36 at a vertical location immediately below the absorptive insert 16 in the assembled package. The bead 40 has a tapered lower or lead-in surface 42. The upper surface 44 of bead 40 is also tapered to permit the closure to be stripped from the mold following its manufacture. As will be noted from FIG. 2, the internal diameter of bead 40 is larger than the external dimension of socket 26 to prevent contact therebetween when the closure 18 is applied.

A coaxial, pressure exerting element, ring-like protrusion 46, depends from the central interior of topwall 34 of closure 18. The distal end 48 of protrusion 46 is rounded and is adapted, when the closure 18 is applied and tightened, to contact and exert axially downwardly directed force on ball 14 thereby pressing it into sealing contact with sealing ridge 30 at the lower end of socket 26. As will be understood by those skilled in the dispenser art, the various dimensions of the closure 18, ball 14 and container 12 are set up so as to permit the sealing to occur when the closure is in its fully telescoped condition, enclosing the socket 26 and ball 14.

An annular rib 50 depends coaxially from the interior peripheral portion of topwall 34 of closure 36. The rib 50 is tapered so that the rib becomes thinner in an outward direction and is positioned to contact and penetrate into or crush a medial portion of absorptive insert 16 when the closure is initially brought to its fully telescoped condition, as will be more fully understood from subsequent description.

The absorptive insert 16 is preferably a flexible ring of generally rectangular cross section. It has an outer diameter slightly larger than the inner diameter of bead 40 and slightly smaller than that of the upper internal sidewall 36 of closure 18, and an inner diameter generally matching that of the lip 32 of socket 26. In the initial assembly of the package 10, the absorptive insert 16 is placed within the closure 18 and pressed axially upwardly, past the bead 40, into the upper corner of closure 18. The flexibility of the ring and the tapered lead-in surface 42 permit the absorptive insert to be easily snapped into position, where it is subsequently supported and retained by the bead 40.

In the embodiment shown, the height of the absorptive insert 16 is set, aside from considerations of absorptive capacity and gross dimensional relationships of the package components, taking into account the dimensional tolerances of the package parts. The height of the insert 16 is nominally equal to the distance between the lower surface of rib 50 and lip 32 in the assembled and sealed condition, plus the sum of the tolerances of the package components which could cause that dimension to increase. The object is to have the lower extremity of insert 16, surface 52, make contact with lip 32 along substantially the entire perimeter thereof.

However, it will be realized that if the compressive strength of insert 16 is large enough, an insert which is too high could prevent the formation of the primary seal between ball 14 and sealing ridge 30. On the other hand, if the insert is too short there would be insufficient pressure along insert 16 to assure the desired contact with lip 32. These problems are ameliorated by the presence of depending rib 50 which functions to compensate for minor variatons in the axial dimensions of the package parts by variation in the depth of its penetration into the medial portion of the upper extremity 54 of absorptive insert 16.

The dimensions of the rib 50 will therefore be dependent on the compressive strength or crush resistance of the insert 16 and how much force should be exerted against it to bring surface 52 into intimate contact with lip 32. For example, where the material comprising absorptive insert 16 has compressibility characteristics such that a sample 1 cm. in height can be compressed 0.254 cm. by the application thereto of compressive stress of 12 kilograms/cm.$^2$, and the nominal height dimension of said insert 16 is about 0.96 cm., it has been found satisfactory for the rib 50 to have a lower surface width of about 0.063 cm. and a height of about 0.082 cm., with the sidewalls thereof each lying at a 15° angle with the vertical. The amount of stress required to achieve the described amount of compression is hereinafter referred to as "stress of compression".

The insert 16 can be made of any porous, absorptive, non-hygroscopic material which is chemically unreactive with the product to be dispensed and which possesses a desirable mix of low critical surface tension, capillarity and the like to provide capillary attraction with the fugitive component of the product such as to cause its preferential migration into the material rather than spreading on the surface of the container 12 when the liquid is in contact with both. This can be tested by placing a small amount of the liquid on the container 12 surface and placing an edge of the insert material on such surface and through the liquid. One can then determine by observation whether the liquid is drawn into the material or spreads on the container 12 surface.

Depending on the type of structure of the insert 16, it's manner of mounting, the type of liquid involved, the desired appearance of the insert 15 and the like, such materials could comprise sintered microporous metals or polymers, fibrous pads or sponges or the like. In the illustrated embodiment, however, such material is preferably a microporous polymer characterized by a relatively homogeneous, threedimensional open cellular structure in which the cells are interconnected by smaller pores, creating a labyrinth of capillary channels having a surface area per unit of volume which is very high. Such microporous materials can, for example, be made in accordance with the methods of U.S. Pat. No. 4,247,498, which issued to A. J. Castro on Jan. 27, 1981, the disclosures of which are hereby incorporated by reference. These materials are available commercially under the trademark "Accurel" (from Armak Company, Accurel Systems Division, of Chicago, Ill.) in a variety of polymers and copolymers.

Preferably, also, the microporous material is made of polypropylene, has a void volume in the range of from about 50% to about 95%, most preferably 75%; a median cell size of from about 10 to about 100 microns, most preferably 50 microns; and a median pore size of from about 1 to about 30 microns, most preferably 20 microns; and a stress of compression of from about 8 to about 15 kilogm/cm.$^2$, most preferably 12 kilogm/cm.$^2$.

In use, the product is placed in the container 12, the ball 14 is snapped into socket 26, the closure 18 (with the absorptive insert 16 mounted therein) is telescoped thereover and the closure 18 screwed down to its fully telescoped, sealing position, wherein protrusion 46 forces ball 14 into sealing contact with sealing ridge 30. During application of the closure 18, the surface 52 of absorptive insert 16 comes into contact with lip 32 of socket 26, preventing the insert 16 from moving further downwardly with the closure 18. Thereafter, relative vertical motion between the insert 16 and the closure 18 occurs, during the course of which rib 50 is forced into the upper extremity 54 of the insert 16. This presses the surface 52 into close contact with the lip 32, but does not interfere with the establishment of the primary seal below ball 14. The surface 52 should preferably not contact ball 14. If trace amounts of the fugitive liquid should thereafter escape through the seal and migrate to the lip 32, the insert 16 will absorb the liquid rather than let the same migrate to the exterior surface of container 12. As a result no liquid will be present on the package 10 to detract from its appearance or tactile impression.

Various modifications of the described invention will be apparent to those skilled in the art. For example, while the package shown and described is a ball applicator package, with appropriate changes the invention is equally applicable to other types of spheroidal applicator elements, such as rollers the surfaces of which are shaped as ellipsoids of revolution. Similarly, although screw threads were described as the preferred means of affixing the closure to the container, a snap-on connection could also be used and, in addition, other techniques could be employed for achieving the primary seal; for example, providing a sealing ridge which is rounded, or establishing such seal at the top of the applicator socket. Accordingly, the scope of the present invention should be considered in terms of the following claims and is understood not to be limited to the details of structure and operation described and shown in the specification and drawings.

I claim:

1. A roll-on applicating package adapted to contain and dispense products incorporating a liquid having a very low surface tension, said package comprising:

a container comprising a body portion adapted to receive the product and having an integrally formed upper portion which includes an applicator socket terminating in a lip;

a spheroidal applicator element rotatably disposed within said socket with said lip circumscribing and thereby enclosing a major portion of said applicator element within said socket;

a closure telescoped over and enclosing said socket and applicator element, said closure comprising a topwall, a depending skirt-like sidewall, and a depending rib formed integrally on the interior peripheral portion of said topwall, and having mounted therein a porous, absorptive insert having a lower surface which is in intimate contact with said lip along substantially its entire perimeter;

means to affix said closure to said container when said closure is in telescoped condition; and means to establish a continuous primary mechanical seal between the said applicator element and the said socket and adapted to resist leakage of said product therethrough when said closure is in telescoped condition;

said absorptive insert comprising a microporous polymer which is chemically unreactive with said product and has an open cellular structure, a void volume in the range of from about 50% to about 95%, a median cell size of from about 10 to about 100 microns, a median pore size of from about 1 to about 30 microns, and a stress of compression in the range of from about 8 to about 15 kilograms/cm.$^2$ and which possesses capillary attraction with said liquid of a magnitude sufficient to cause preferential migration of said liquid into said microporous polymer rather than spreading on the exterior surface of said container when said liquid is in contact with both, whereby upon application of said closure into telescoped condition the compressibility characteristics of said microporous polymer permit sufficient penetration by said depending rib to insure that said insert is brought into intimate contact with said lip such that fugitive liquid which may leak through said primary seal when said closure is in telescoped condition is absorbed and held within said insert as a result of said capillary attraction.

2. The roll-on applicating package of claim 1 in which said microporous polymer is polypropylene.

3. The roll-on applicating package of claims 1 or 2 in which said absorptive insert is in the form of a ring of generally rectangular cross section mounted coaxially within said closure with its lower extremity comprising said surface in intimate contact with said lip, the interior transverse dimensions of said ring generally matching those of said lip.

4. The roll-on applicating package of claim 3 in which the applicating element is a ball; the means to affix said closure to said container are cooperating threads on the interior of the closure sidewall and an upper portion of the container, the means to establish a continuous primary seal are a transverse annular sealing shoulder within the socket interior and a coaxial, pressure exerting element depending from and integrally formed with the closure topwall; and in which said depending rib integrally formed on said closure topwall is annular and in alignment with the ring and adapted to compensate for minor variations in axial dimension of the package parts by variation in the depth of its penetration into the ring.

* * * * *